United States Patent [19]

Pepin-Lehalleur et al.

[11] Patent Number: 4,895,481

[45] Date of Patent: Jan. 23, 1990

[54] NON-RIGID MARINE PLATFORM WITH SURFACE WELLHEADS

[75] Inventors: Jean F. M. Pepin-Lehalleur; Loic M. J. Danguy des Deserts, both of Paris, France

[73] Assignee: Doris Engineering, Paris, France

[21] Appl. No.: 146,177

[22] Filed: Jan. 20, 1988

[30] Foreign Application Priority Data

Jan. 29, 1987 [FR] France ..... 87 01056

[51] Int. Cl.[4] ..... E02B 17/00

[52] U.S. Cl. ..... 405/224; 405/195; 405/204

[58] Field of Search ..... 405/224, 225, 227, 202, 405/195, 204; 166/350, 359, 367

[56] References Cited

U.S. PATENT DOCUMENTS

| | | | |
|---|---|---|---|
| 3,517,517 | 6/1970 | Blenkarn | 405/224 |
| 3,572,272 | 3/1971 | Dixon et al. | 405/224 X |
| 3,982,401 | 9/1976 | Loggins | 405/224 |
| 3,996,755 | 12/1976 | Kalinonski | 405/224 X |
| 4,363,568 | 12/1982 | Schuh | 405/224 X |
| 4,423,983 | 1/1984 | Dadiyas et al. | 405/195 |

*Primary Examiner*—Dennis L. Taylor

*Attorney, Agent, or Firm*—Watson, Cole, Grindle & Watson

[57] ABSTRACT

A platform consisting of a rigid structure supporting the deck, floats fixed to the lower part of the rigid structure, and flexible structure formed of piles fixed by their upper ends to the rigid structure and to the floats and by their lower ends to a base provided on the seabed, the piles being held under tension.

10 Claims, 3 Drawing Sheets

FIG.: 2
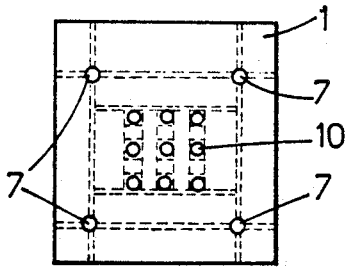
FIG.: 3
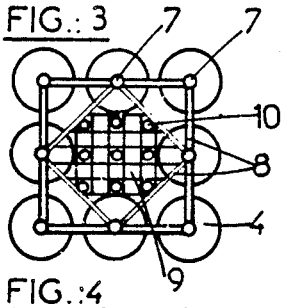
FIG.:4
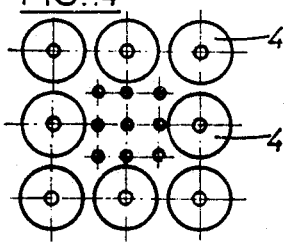
FIG.: 5
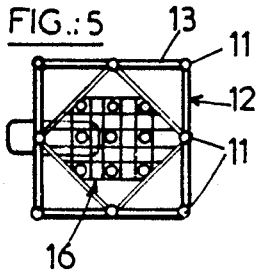
FIG.: 6 A
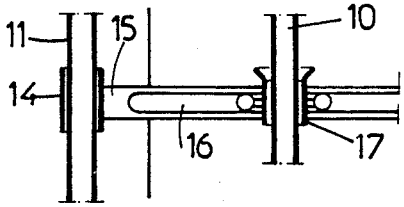
FIG.: 6 B
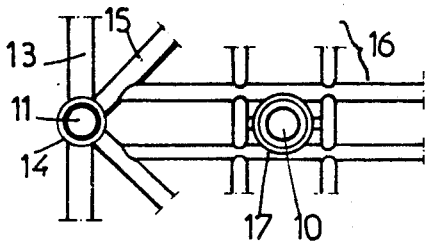
FIG.: 7A
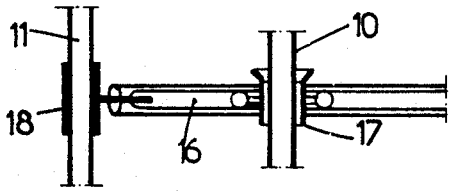
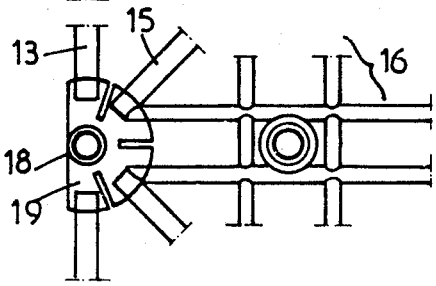
FIG.: 7B

NON-RIGID MARINE PLATFORM WITH SURFACE WELLHEADS

BACKGROUND OF THE INVENTION

The invention relates to a non-rigid marine platform with surface hydrocarbon production wellheads for deep water applications, the platform comprising flexible piles anchored to the seabed and supporting a deck equipped with production means (including the wellheads) connected to the upper end of conducting tubes guided by guide frames spaced along the flexible plies.

Exploitation of hydrocarbons in the deep ocean is today envisaged according to two different arrangements. Either one or more structures of the fixed or compliant type and supporting all the production equipment are mounted on the seabottom, or subsea wellheads are installed in the seabottom and the rest of the production equipment is provided on a floating support consisting of a converted ship or a platform of the semi-submersible type, the wellheads being connected to the floating support by means of flexible riser pipes.

The first type of system has the advantage of using very well known, well tested and highly reliable oil equipment, largely proven in land-based oil developments and in most marine developments, but has the disadvantage of being rather heavy and necessitating an expensive infrastructure. For this reason, this type of arrangement is well suited for the development of large hydrocarbon deposits for which heavy investment is envisaged.

The second type of system has the advantage of using equipment which can be salvaged at the depletion of the hydrocarbon field and may very easily be moved to other production sites. This type of development is thus very suitable for bringing into production marginal fields for which investment must be low, the duration of production generally being quite short.

However, this type of system has the disadvantage of requiring the use of subsea wellheads, which are more expensive than conventional wellheads, and in particular much more difficult to install, operate and maintain.

Furthermore, the connection by flexible risers between the floating support and the seabottom is always delicate and requires a relatively high degree of maintenance.

SUMMARY OF THE INVENTION

The aim of the invention is to combine the advantages of the above two types of systems while eliminating their major disadvantages. The platform according to the invention is capable of supporting the wellheads, the other production equipment being installed on a floating support of the known type, not constituting part of the invention. The platform and floating support are connected by a flexible connection permitting their relative movement.

The floating support, anchored by means of chains and cables or any other known means, and the platform subject of the invention, connected to a base by means of flexible piles, may be integrally salvaged when exploitation of the hydrocarbon deposit is complete and reinstalled at another location at relatively low cost.

The platform according to the invention is remarkable in that it consists of a rigid structure supporting the deck, floats fixed to the lower part of the rigid structure and a flexible structure formed by piles fixed at their upper ends to the rigid structure and to the floats, and at their lower ends to a base provided on the sea bed, the piles being held under tension by the buoyancy of the floats.

The explanations and figures given below by way of example will permit an understanding of how the invention may be realized.

BRIEF DESCRIPTION OF THE DRAWINGS

FIG. 7 is an elevational view of an embodiment of a platform according to the invention, FIGS. 2, 3, 4 and 5 are sectional views according to II—II, III—III, IV—IV and V—V of FIG. 1, FIGS. 6A and 6B are, respectively, a partial longitudinal sectional view of the region adjacent section V—V of FIG. 5 showing a first embodiment of a guide structure and an enlarged plan view of a portion of FIG. 5 including the structure, FIGS. 7A and 7B are, respectively, a partial longitudinal sectional view of the region adjacent the section V—V of FIG. 5 showing a second embodiment of a guide structure and an enlarged plan view of a portion of FIG. 5 including the structure.

DETAILED DESCRIPTION OF THE PREFERRED EMBODIMENTS

Figure 1:
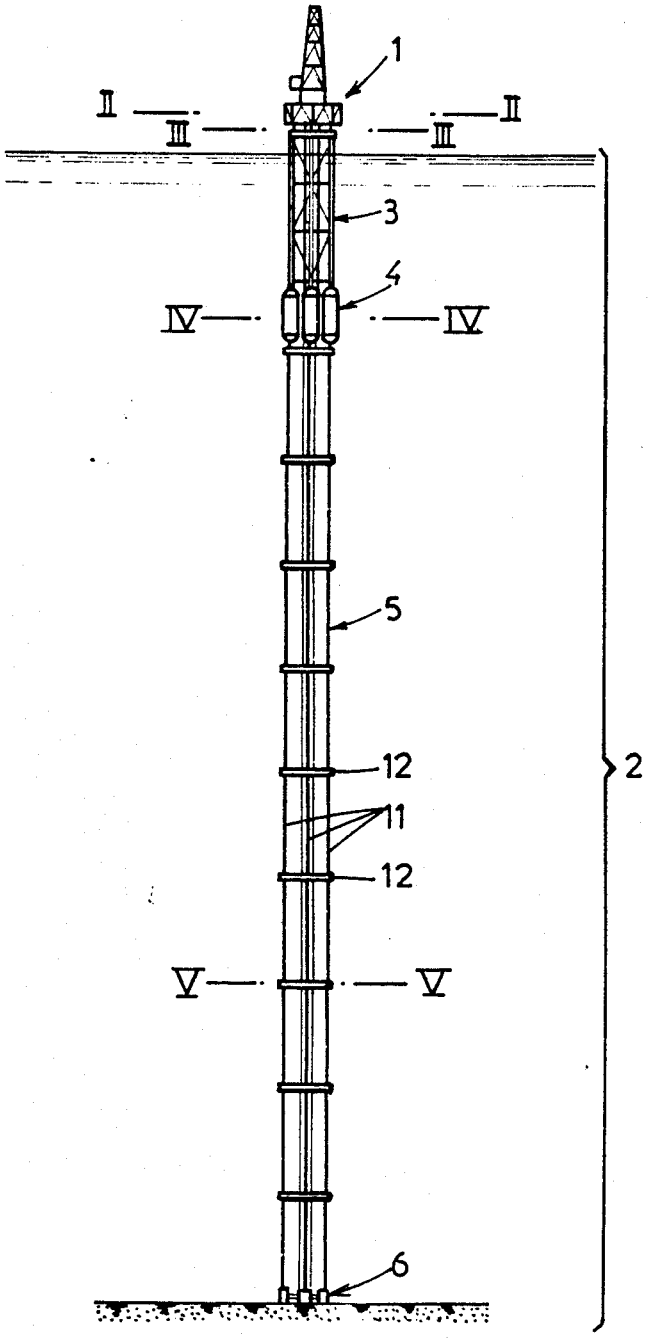

The platform according to the invention, shown in FIG. 1, conventionally comprises a deck 1 supported by a tower 2 anchored in the sea bed.

The production wellheads are installed within the deck.

The tower 2 comprises three parts: at the upper part, supporting the deck, a rigid metal lattice structure 3; in the intermediate position, floats 4 supporting the lattice structure; and at the lower part a flexible structure 5 anchored at the bottom of the seabed by a base 6 and connected at its upper end to the floats 4.

According to the embodiment shown, the lattice structure 3 is formed by eight legs 7 arranged at the corners of a square (FIGS. 2 and 3) and in the middle of its sides.

These legs are braced in horizontal planes by members 8 and by diagonals in vertical planes.

The brace members 8 in the horizontal planes carry guide structures 9 for conducting tubes 10.

According to the embodiment shown, the lower ends of the legs and their braces are fixed to the upper part of the floats 4 which are arranged in the same configuration as the legs 7 of the lattice structure 3. These floats are metal cylinders with convex bottoms.

The floats are situated at a level sufficiently deep to reduce the hydrodynamic forces induced by the swell and applied to the structure.

The choice of level depends on the site water-depth and the waveheight which may occur. The upper part of the floats is situated in a zone between 15 and 50 meters below the mean level of the water.

According to a first embodiment of the junction of the flexible structure 5 with the floats 4 and the lattice structure 3, the upper end of each of the piles 11 of the flexible structure is fixed to the lower end of the floats 4.

According to a second embodiment of the junction of the flexible structure 5 with the upper parts of the tower shown in FIGS. 1 to 4, the upper ends of the piles 11 are fixed at the upper part of the lattice structure 3. To achieve this, the piles pass longitudinally through the floats 4 through a central tube fixed along the axis of each float, the central tube being fixed in a water-tight manner to the convex bottoms of the floats 4, and pass into the inside of the legs 7 of the lattice structure 3. Fastening of the piles to the upper part of the tower is effected easily and allows initial adjustment of the tension of each pile by a known adjustable mechanical system.

According to the embodiment shown, the eight tubular metal piles 11 are arranged at the corners and in the middle of the sides of a square and are connected to the base 6 by means of connectors. These connectors, known as such, may be screwed joints or connections made with injected cement grout.

The base 6 carrying the pile connectors is, according to one exemplary embodiment, of the gravity type. Any other base type, such as one with driven foundation piles or drilled piles, is also suitable.

The flexible structure 5 constituted by the piles 11 carries at regular intervals guide frames 12 for the conducting tubes 10 which extend from the seabed to the deck where the wellheads are installed.

The guide frames 12 consist, according to the embodiment in FIGS. 6A and 6B, of a tubular frame 13 carrying at its corners and in the middle of its sides sleeves 14 freely moving on the piles 11. Braces 15 connect the middles of the sides of the square and support a grid 16 between the meshes of which are fixed guides 17 freely surrounding the conducting tube 10.

The sleeves 14 and the guides 17 of the guide frames allows relative movement between the piles and conducting tubes and do not limit the flexibility of the flexible structure 5.

The guide frames are held in position with respect to each other by suspension means such as cables or chains fixed to the lower part of the floats 4.

According to a second embodiment of the guide frames according to FIGS. 7A and 7B, the sleeves 18 are fixed to the tubular frames 13 and to the braces 15 be pseudo-joints 19 consisting of sheet plates with low inertia of deflection in the form, for example, of semicircles carrying radial notches forming sectors on which are fixed the ends of the elements forming the frame and the braces.

The remaining parts of the guide frames are in every way similar to those described in the preceding embodiment.

According to one characteristic of the invention, the total tension force exerted by the floats on the piles is greater than the total compression force on the conducting tubes. The piles 11 are thus permanently under tension and prevent buckling of the conducting tubes.

One of the main advantages of the platform according to the invention is to allow drilling from the deck and the installation of wellheads using conventional equipment eliminating the need of a conducting tubes tensioning system.

Figure 8A:
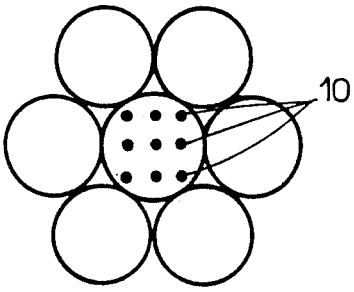
FIG. 8 is a partial view of a platform according to a second embodiment of the present invention wherein the floats thereof are in the form of a multi-cell concrete structure, FIG. **8*a* is a cross-sectional view of FIG. 8 as seen along line A—A therein.
Figure 8:
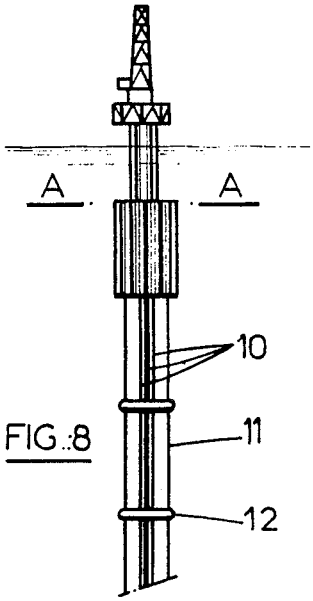
Figure 9A:
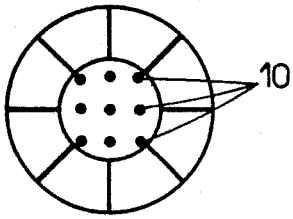
FIG. 9*a* is a cross-sectional view of FIG. 9** as seen along line B—B therein.
Figure 9:
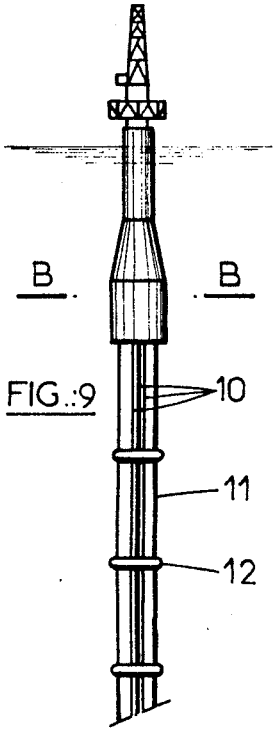
FIG. 9 is a partial view of a platform according to a third embodiment of the present invention wherein the lattice structure thereof is in the form of a shaft.

As seen in FIGS. 8, 8*a*, and 9*a*, the structure can be the form of a metal shaft or a multi-cell concrete structure, and the floats also can be in the form of a multi-cell concrete structure.

We claim:

1. A non-rigid marine platform for use in deep water applications which comprises:

a base which is positioned on a seabed, a rigid structure, the rigid structure including a plurality of floats located below a surface of the water, a lattice structure which extends upwardly from the floats and above the surface of the water, and a deck with production wellheads mounted on the lattice structure so as to be positioned above the surface of the water, a plurality of conducting tubes which extend from the seabed upwardly to the rigid structure to connect with the production wellheads, a plurality of flexible, tubular piles which extend upwardly from the base to the rigid structure, the tubular piles being held under a total tension force exerted thereon by the floats of the rigid structure which is greater than the total compression force on the conducting tubes, and a plurality of guide frames at spaced apart locations along the plurality of tubular piles between the base and the rigid structure and through which the plurality of tubular piles and the plurality of conductors pass.

2. A non-rigid marine platform according to claim 1, wherein each of the guide frames includes a plurality of sleeves, each sleeve surrounding a respective tubular pile.

3. A non-rigid marine platform according to claim 1, wherein each of the guide frames includes a plurality of pseudo-joints, each pseudo-joint being connected to a respective tubular pile.

4. A non-rigid marine platform according to claim 1, wherein the rigid structure consists of a metal shaft.

5. A non-rigid marine platform according to claim 1, wherein the rigid structure of a multi-cell concrete structure.

6. A non-rigid marine platform according to claim 1, wherein each of the guide frames includes a grid which laterally guides the plurality of conducted tubes.

7. A non-rigid marine platform according to claim 1, wherein the plurality of floats consists of a plurality of metal cylinders.

8. A non-rigid marine platform according to claim 1, wherein the floats consist of a multi-cell concrete structure.

9. A non-rigid marine platform according to claim 5, wherein the plurality of piles include upper ends, wherein the plurality of metal cylinders have lower ends, and wherein the upper ends of the plurality of piles are connected to the lower ends of the plurality of metal cylinders.

10. A non-rigid marine platform according to claim 1, wherein the plurality of piles include upper ends, wherein the rigid structure has an upper part, and wherein the piles pass through the floats and the upper ends of the piles are attached to the upper part of the rigid structure.

* * * * *